US012690705B2

(12) United States Patent
Singh

(10) Patent No.: US 12,690,705 B2
(45) Date of Patent: Jul. 28, 2026

(54) FOOD PLATE WITH GLASS HOLDER AND A HANDLE

(71) Applicant: Angad Singh, Bethesda, MD (US)

(72) Inventor: Angad Singh, Bethesda, MD (US)

( * ) Notice: Subject to any disclaimer, the term of this patent is extended or adjusted under 35 U.S.C. 154(b) by 0 days.

(21) Appl. No.: 18/372,087

(22) Filed: Sep. 23, 2023

(65) Prior Publication Data

US 2024/0023736 A1 Jan. 25, 2024

Related U.S. Application Data

(63) Continuation-in-part of application No. 16/729,891, filed on Dec. 30, 2019, now abandoned.

(51) Int. Cl.
*A47G 19/06* (2006.01)
*A47G 19/02* (2006.01)

(52) U.S. Cl.
CPC ..... *A47G 19/065* (2013.01); *A47G 19/02* (2013.01)

(58) Field of Classification Search
CPC ... A47G 19/06; A47G 19/065; A47G 23/0625
USPC ..... 220/23.4, 575, 23.83, 574, 737; 206/557
See application file for complete search history.

(56) References Cited

U.S. PATENT DOCUMENTS

| | | | | |
|---|---|---|---|---|
| 2,603,439 A * | 7/1952 | Le Vesconte | A47G 19/08 | 248/156 |
| 4,989,742 A * | 2/1991 | Powell | A47G 19/06 | 220/737 |
| 5,971,139 A * | 10/1999 | Bradley | A47G 19/06 | 206/217 |
| 8,276,524 B2 * | 10/2012 | Goode | A47G 19/00 | 108/94 |
| 8,573,437 B1 * | 11/2013 | Evans | A47J 45/00 | 220/574 |

* cited by examiner

*Primary Examiner* — Nathan J Jenness
*Assistant Examiner* — Elizabeth J Volz
(74) *Attorney, Agent, or Firm* — Angad Singh

(57) ABSTRACT

The current invention discloses a food plate (1) with a glass holder (3) and a handle (2) in the middle. A person holds the plate and glass-holder combination from the handle (2) with his hand (5) wrapped around the handle. The handle (4) may be detachable from the plate, the glass holder or both.

8 Claims, 2 Drawing Sheets

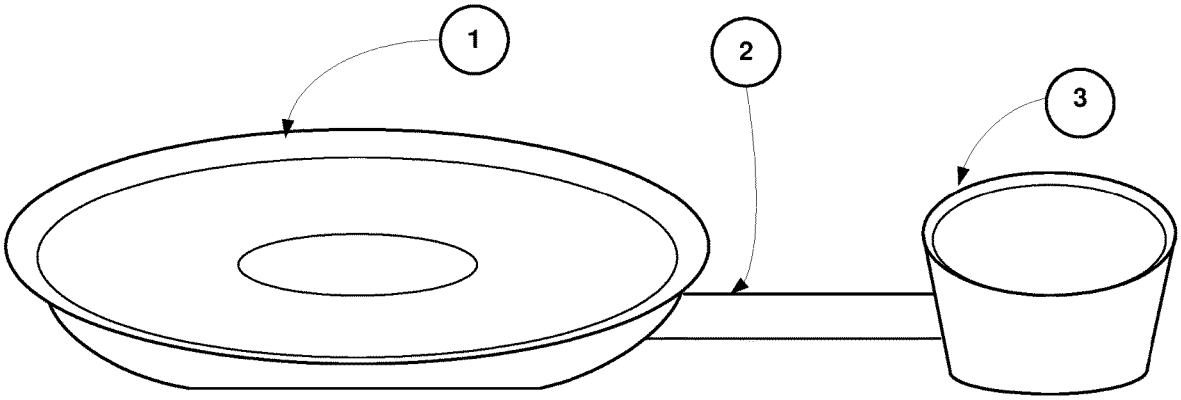
Figure 1. Plate with Glass Holder and Handle
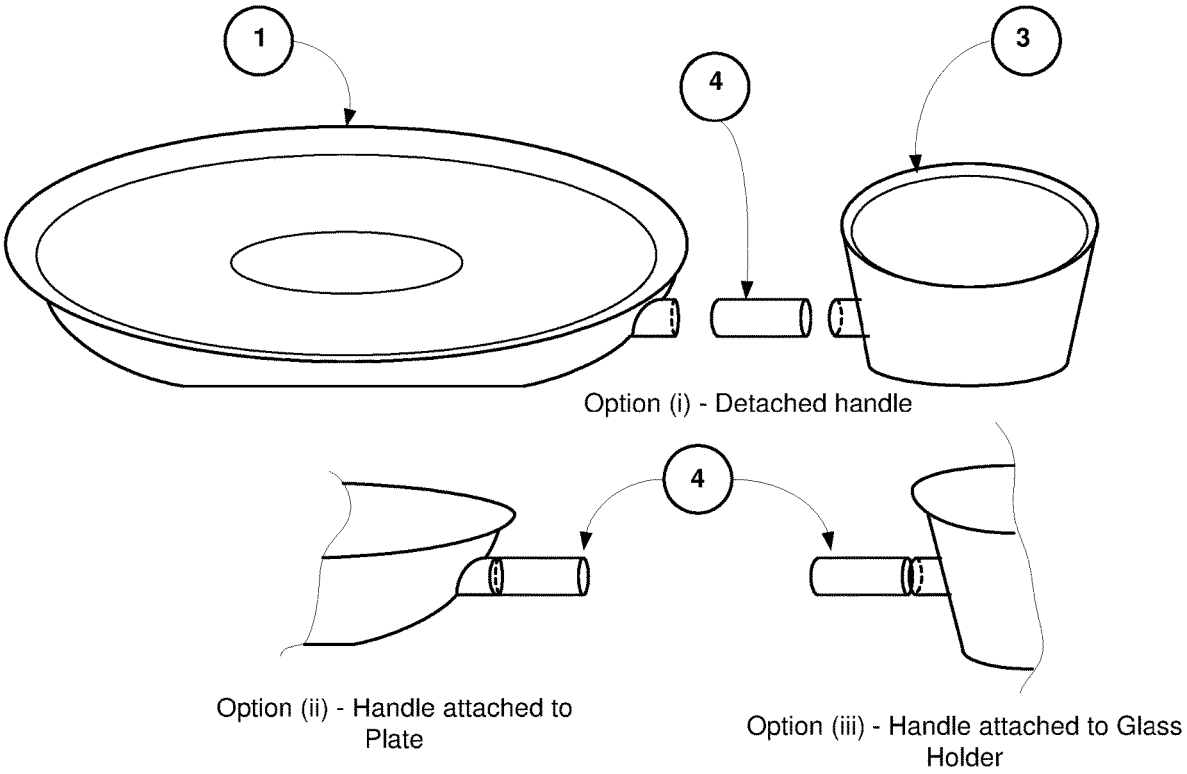
Figure 2. Plate with Detachable Handle and Glass Holder

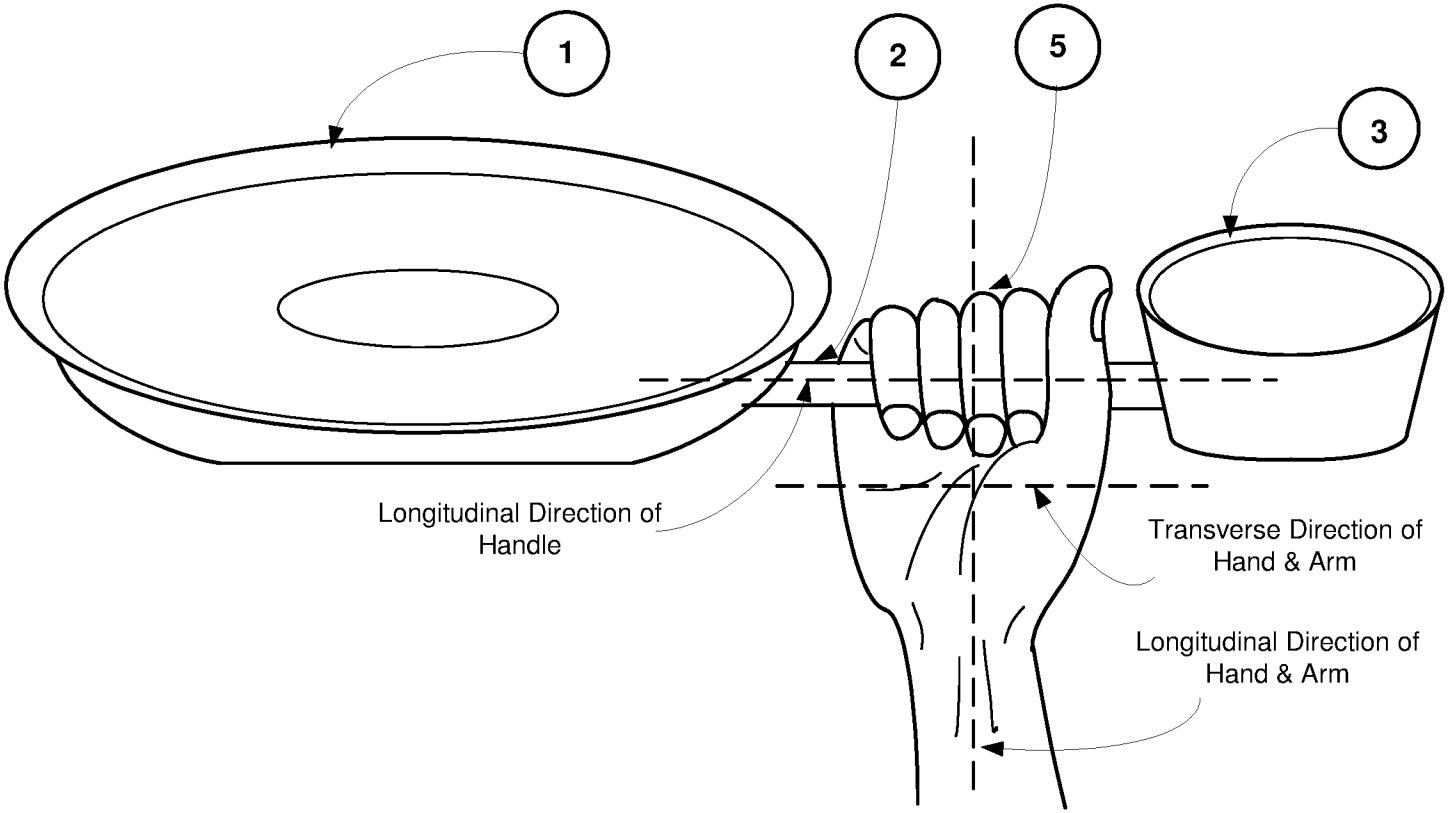
Figure 3. Plate with Glass Holder, Straight Handle and Hand

FOOD PLATE WITH GLASS HOLDER AND A HANDLE

CROSS REFERENCE TO RELATED APPLICATION

This continuation-in-part (CIP) application claims the benefit of the earlier filing date of the U.S. patent application Ser. No. 16/729,891 filed on Dec. 30, 2019, having common inventorship, the entire contents of which are incorporated herein.

No text or Figures from the original application Ser. No. 16/729,891 have been changed or deleted. New paragraphs [0002], [0009], and [0010] (Figure Titles), and new Reference Numeral (5) have been added. Additionally, new text paragraphs [00013] to [0014], and new FIGS. 3 comprising new subject matter have been added. Consequently, the paragraph number sequence has been updated.

BACKGROUND OF THE INVENTION

Field of Invention

The present invention relates to the field of food plates with glass holders used in parties and other such occasions.

RELATED U.S. PATENTS

| Pat. No. | Issue Date | Patentee |
|---|---|---|
| U.S. Pat. No. 4,461,396 | Jul. 24, 1984 | James Harper |

RELATED U. S. PATENT APPLICATION PUBLICATIONS

| Publication Number | Publication Date | Applicant |
|---|---|---|
| US 2015/0136792 A1 | May 21, 2015 | Alice Xinyi Cai |
| US 2012/0000915 A1 | Jan. 5, 2012 | Kevin W. Swallow |
| US 2016/0073804 A1 | Mar. 17, 2016 | Andrew Mikesell |
| US 2006/0283853 A1 | Dec. 21, 2006 | Amanda Phifer |
| US 2017/0303711 A1 | Oct. 26, 2017 | Lisa Bell |
| US 2014/0239000 A1 | Aug. 28, 2014 | Gregory Evans |

RELATED FOREIGN PATENT DOCUMENTS

| Foreign Doc. No. | Country Code Publication Date | Applicant/Patentee |
|---|---|---|
| NONE | | |

For birthday parties, weddings and other such occasions, the traditional circular plates are still being used. During most of such parties, people eat and drink in standing position while mingling with each other. The common problem faced by people in such parties is—how to hold a drinking glass in one hand, the food plate in other hand and eat while standing.

A number of solutions to this problem have been offered by inventors in the past, but all of those prior arts have deficiencies. Almost all prior inventions place the glass holder either in the middle, or near the edge of the circular plate. In such configurations:

(i) The glass interferes with eating of the food just behind the glass
(ii) The semi-liquid food like soup can drip from the gap between the plate edge and glass
(iii) The glass adds to the weight of the plate with food
(iv) The whole weight is lob-sided making it difficult to balance with one hand
(v) The plate does not have a place to hold firmly with one hand With the result, no prior art has been widely adopted by people till date.

BRIEF SUMMARY OF THE INVENTION

The current invention overcomes above shortcomings of the prior art and offers a ubiquitous solution allowing a person to comfortably hold the plate and glass with one hand and eat the food with other hand in parties etc.

BRIEF DESCRIPTION OF DRAWINGS

FIG. 1 illustrates food plate, glass holder and handle in the middle.

FIG. 2 illustrates food plate, glass holder and detachable handle options

FIG. 3 illustrates food plate, glass holder, hand and the handle

REFERENCE NUMERALS

| | | | |
|---|---|---|---|
| (1) Food Plate | (2) Attached Handle | (3) Glass Holder | (4) Detachable Handle |
| (5) Complete Hand | | | |

DETAILED DESCRIPTION OF THE INVENTION

FIG. 1, the first embodiment of the invention, illustrates the food plate (1), the glass holder (3) and the handle (2) in the middle. The person holds the plate-glass combination with one hand around the handle (2) located in the middle. This configuration overcomes all shortcomings listed above in paragraph [005]. Since the handle (2) is in the middle, the weight of food plate on one side and drink glass on the other creates a good balance.

FIG. 2, the second embodiment of the invention, illustrates the food plate (1), the glass holder (2), and a detachable handle (4). When a person finishes his drink, he may detach the glass holder. He can continue to hold the plate from the handle attached to the plate. The handle may be permanently attached either to the plate or to the glass holder; or may be removable from both the plate and the glass holder. The handle may be of any shape and size, and it may have any attachment mechanism suitable for the shape, size and material of the plate, handle and the glass holder.

The major drawback of holding the plate & glass-holder combination with partial hand (just fingers as disclosed by some prior art) is that, without the support of the palm, fingers get tired after sometime supporting the entire weight. The globally accepted definition of the hand, adopted within the scope of this invention, is the palm and fingers.

FIG. 3 shows a complete hand (5), comprising the palm and fingers, wrapped around the handle (2, 4) in the form of a fist. The handle (2, 4) is substantially long to accommodate a complete hand wrapped around it (FIG. 3). The weight of the plate & glass holder combination is substantially supported by the palm of one hand while the user eats the food, and drinks from the glass with the other hand. The hand (5) holds the handle (2, 4) in the transverse direction of the hand and arm, and in the longitudinal direction of the handle, as illustrated in FIG. 3. Besides the glass, the holder can accommodate a cup, mug, bottle or any container containing a liquid for drinking.

The invention claimed is:

1. A food plate (1) and a glass holder (3) permanently attached to each other with a handle (2) in the middle, wherein:

the food plate (1) and the glass holder (3) are located on either side of the handle (2) in a longitudinal direction of the handle (2);

a top surface of the food plate (1) and the longitudinal direction of the handle (2) are not at a right angle to each other;

the handle (2) is substantially long allowing the food plate (1) and the glass-holder (3) to be located on either side of a hand (5) in a transverse direction of the hand (5), when the handle (2) is held with a complete hand (5) wrapped around the handle (2), including the palm and fingers in the form of a fist.

2. The food plate (1) of claim 1, wherein the handle (2) in the middle enables a person to hold the plate (1) and glass-holder (3) combination with one hand, and eat and drink with other hand, wherein the weight of the food plate & glass holder combination is substantially supported by the palm of the hand (5).

3. The food plate (1) of claim 1, wherein the handle (2) is of tubular form.

4. A food plate (1) and a glass holder (3) attached to each other with a detachable handle (4) in the middle, wherein:

the food plate (1) and the glass holder (3) are located on either side of the handle (4) in a longitudinal direction of the handle (4);

a top surface of the food plate (1) and the longitudinal direction of the handle (4) are not at a right angle to each other;

the handle (4) is substantially long allowing the food plate (1) and the glass-holder (3) to be located on either side of a hand (5) in a transverse direction of the hand (5), when the handle (4) is held with the complete hand (5) wrapped around the handle (4), including the palm and fingers in the form of a fist.

5. The food plate (1) of claim 4, wherein the handle (4) is detachable from the food plate (1), or detachable from the glass holder (3), or both.

6. The food plate (1) of claim 4, wherein the handle (4) in the middle enables a person to hold the plate (1) and glass-holder (3) combination with one hand, and eat and drink with other hand, wherein the weight of the food plate and glass holder combination is substantially supported by the palm of the hand (5).

7. The food plate (1) of claim 1 or claim 4 wherein the glass holder (3) can accommodate a glass, or a cup or a mug or any other container for containing the drink.

8. The food plate (1) of claim 4, wherein the handle (4) is of tubular form.

* * * * *